United States Patent [19]

Sexton

[11] Patent Number: 4,918,420

[45] Date of Patent: Apr. 17, 1990

[54] MINIATURE FUSE

[76] Inventor: William Sexton, 418 Franklin St., Porter, Ind. 46304

[21] Appl. No.: 267,395

[22] Filed: Nov. 4, 1988

Related U.S. Application Data

[63] Continuation-in-part of Ser. No. 80,799, Aug. 8, 1987.

[51] Int. Cl.[4] ..... H01H 85/02; H01H 85/14

[52] U.S. Cl. ..... 337/205; 337/228; 337/247

[58] Field of Search ..... 337/205, 201, 186, 206, 337/252, 241, 265, 247

[56] References Cited

U.S. PATENT DOCUMENTS 3,275,772 9/1966 Neff ..... 337/247

4,460,887 7/1984 McAlear ..... 337/186

4,734,059 3/1988 Melugin ..... 337/201

*Primary Examiner*—H. Broome

[57] ABSTRACT

A miniature cartridge-type fuse comprises a sub-assembly of an inner insulating housing made of a transparent glass or glass-like material which cannot withstand the forces of a short circuit overload, and end cap terminals at the ends of the housing. A transparent encapsulating body is preferably molded immovably around the inner housing and covers, seals and physically interconnects the exposed exterior surfaces of the inner housing and terminals. The encapsulating body prevents the hazardous destruction of the fuse under all overload conditions and enables the fuse element to be seen through the encapsulation body and inner housing.

6 Claims, 2 Drawing Sheets

FIG. 6
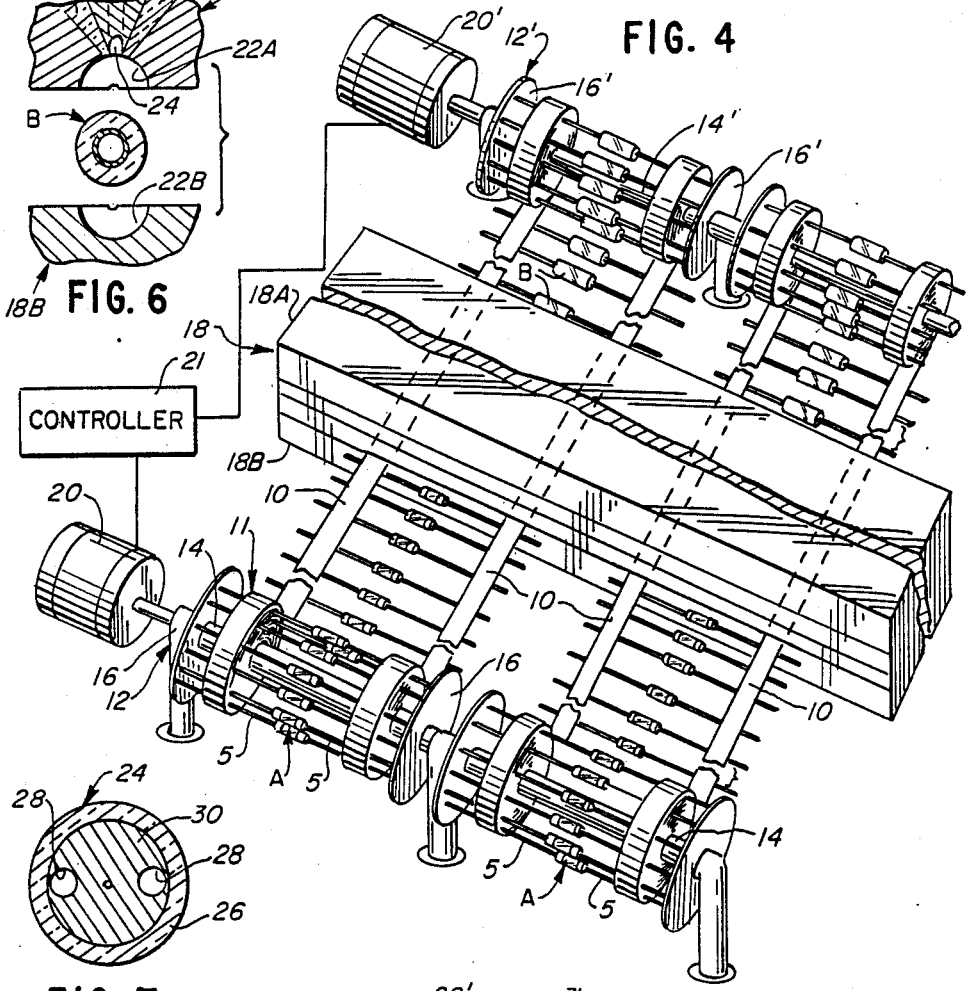
FIG. 4
FIG. 7
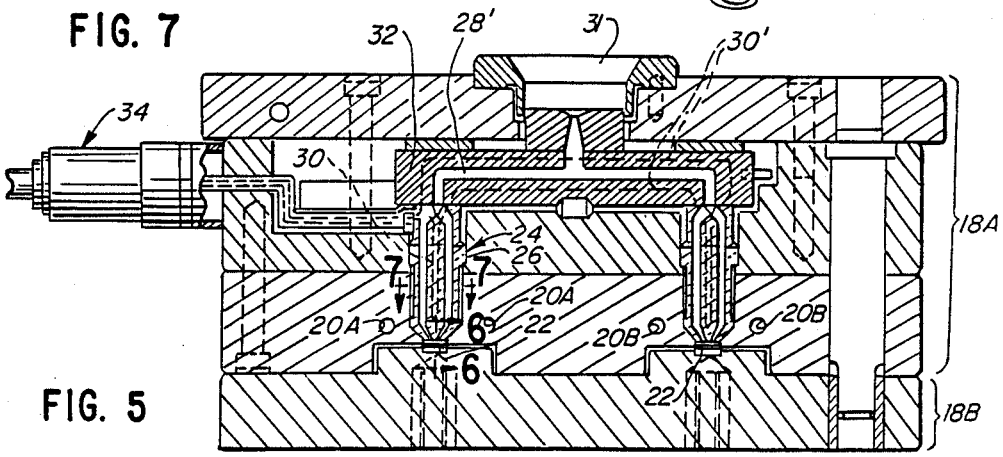
FIG. 5

MINIATURE FUSE

TECHNICAL FIELD

The present invention relates to improvements in electrical fuses, particularly to miniature cartridge fuses where, typically, the fuse blowing conditions have heretofore required ceramic fuse housings to prevent the fuse from blowing up under severe high overload conditions. Glass housings of the small size and thickness required of such miniature fuses would not be expected to withstand the stresses especially of a short circuit condition, without a hazardous shattering of the housing.

The present invention is an improvement in the miniature fuse disclosed in U.S. Pat. No. 4,460,887, granted July 17, 1984, and which, in its most useful form, can have an overall diameter of as little as about 0.1 inch and a housing length a short as about one quarter inch, even for rated current of as much as 15 amps. The invention has also been used on 100 amp fuses with a diameter of about 0.250 inches and a length of about 0.4 inches.

RELATED APPLICATION

This application is a continuation-in-part of application Ser. No. 80,799, filed Aug. 3, 1987, entitled Method of Making an Encapsulated Fuse and the Fuse Thereby.

BACKGROUND PRIOR ART

Cartridge type electrical fuses having axial leads have been long known in the fuse art. The fuse element in such a fuse is typically a fusible wire supported within a cylindrical open-ended insulating housing for the fuse and closed by metal end caps carrying outwardly axially extending leads. To insure reliable fusing it is essential that the fuse wire must not touch the interior wall of the housing along the portion of its length which can affect its fuse blowing characteristics; hence, the ends of the fuse wire are supported in such a manner as to prevent such contact. In some fuse designs, the fuse element extends diagonally across the sleeve ends. In such case, the lead carrying end caps having solder therein are used to capture the fuse wire ends folded over the outside of the sleeve ends. The final mechanical assembly consists of press fitting the end caps over the foldedover ends of the fuse wire followed by momentary heating of the solder to obtain good electrical connection between the fuse wire and the end caps.

Where the fuse was a miniature fuse having a housing typically made of ceramic material which cannot be solder bonded without adding a metal coating, the only substantial opposition to the separation of the end caps from the sleeve was derived from the pressure fitting of the end caps over the outer surface of the housing. Thus, such fuse structures were generally weak in tension, and were prone to mechanical failure on a pull test applied to the end leads. An alternative construction was to solder bond the end caps to the housing ends, which requires an expensive local outer metallization of the housing ends. Such structures are prone to humidity induced corrosion problems because of the exposed metal end caps and the lack of any hermetic sealing thereof.

One prior art partial solution to the above-mentioned problems was the application of a length of heat-shrinkable plastic tubing tightly heat shrunk over the housing and end caps, the tubing overlapping, although loosely, the inner ends of the leads extending outwardly from the end caps. The heat shrunk tubing provided some improvement in fuse strength and provided a moderately good sealing for the fuse interior. A disadvantage of this construction was that the cap ends are exposed to the external ambient conditions, owing to the fact that the limited shrinkage capability of the tubing prevented a desired end cap sealing engagement of the heat shrunk tubing prevented a desired end cap sealing engagement of the heat shrunk tubing with the leads. Such sealing is desirable when the fuse is used on printed circuit boards which, after complete assembly of parts on the board, is often dropped into a liquid solvent to clean the board. Also to impart a desired adequate corrosion resistance to the end caps, it was still necessary to plate the still exposed end caps with a corrosion resistance material.

In the fuse encased by the shrink fitted tubing, the resulting structure was still not adequately strong, in that a moderate pull on the leads can still sometimes shift the end caps to break the fuse wire. The shrink tube fitted fuse as described also was more costly to manufacture than desired. Also, because the fuse housing was made of an opaque ceramic material, the fuse wire was not visible even when the shrink tubing was transparent.

To partially overcome the problems referred to, the invention disclosed in U.S. Pat. No. 4,460,887 was developed. As disclosed therein, instead of using shrink tubing as described, an encapsulating body of insulating material, such as an opaque epoxy material, was applied to the fuse so as to cover, seal and physically interconnect the exposed exterior surfaces of the housing and the end caps and to at least seal around the leads extending from the end caps.

As explained in this patent, the epoxy insulating coating was formed by initially applying epoxy powder to a rotated fuse which had been preheated to fuse the epoxy powder. Because of the temperatures involved, it was discovered that blow holes sometimes developed in the epoxy encapsulating body because of out-gassing caused by the heating of the fuse to the epoxy powder fusing temperature. When these fuses were subject to severe high current overload circuit tests, it was found that the blow holes undesirably reduced the insulation resistance of the encapsulating body. Also, the epoxy material was a translucent material so that the fuse wire was not visible, even if the fuse housing were to be made of a transparent material.

It is one of the objects of the present invention to provide a new miniature fuse which is less costly, more reliable and/or more effective than that just described.

BRIEF SUMMARY OF INVENTION

In accordance with one of the aspects of the invention, instead of using a miniature fuse housing made of a strong, opaque ceramic material which could withstand the stresses of a short circuit overload, or re-designing the basic fuse so that it had a single exterior body which adequately both seals and supplies all the strength requirements of the fuse, the present invention uniquely provides a miniature cartridge fuse sub-assembly using a glass or glass-like transparent open ended cylindrical housing not heretofore used for fuses of this size, since it has an inadequate strength to withstand the pressure conditions of short circuit blowout conditions. Instead the main strength of the fuse is provided by a transparent, immovable, encapsulation body applied over the sub-assembly which also seals the fuse and enables the fuse link to be seen through both the encapsulation body and the glass or glass-like housing of the cartridge fuse sub-assembly.

U.S. Pat. No. 4,734,059 shows a conventional full-sized cartridge fuse with a cylindrical housing made of transparent glass designed to withstand short circuit blowing conditions of the fuse. The housing is surrounded by an opaque two-part sleeve slidably mounted around the fuse housing so that these parts can be slidable to one side to permit the fuse link to be viewed through the transparent housing. The fuse disclosed in this patent is therefore completely different from the miniature fuse of the present invention as above described where a transparent, immovable outer encapsulation body surrounds a miniature fuse sub-assembly whose housing is incapable of sustaining by itself the blowing conditions of the fuse.

BRIEF DESCRIPTION OF DRAWINGS

FIG. 4 is a perspective view illustrating the preferred method used to mold an encapsulating body around each fuse subassembly;

FIG. 5 is a vertical transverse section view through the mold assembly showing two cavities and the upper and lower mold-forming parts of this assembly which are respectively moved between spaced and contiguous positions where a mold cavity is formed around one of the fuse sub-assemblies;

FIG. 6 is a transverse sectional view through FIG. 5, taken along section plane 6—6; and FIG. 7 is a transverse sectional view through FIG. 5, taken along section line 7—7 thereof.

DETAILED DESCRIPTION OF INVENTION

Figure 1:
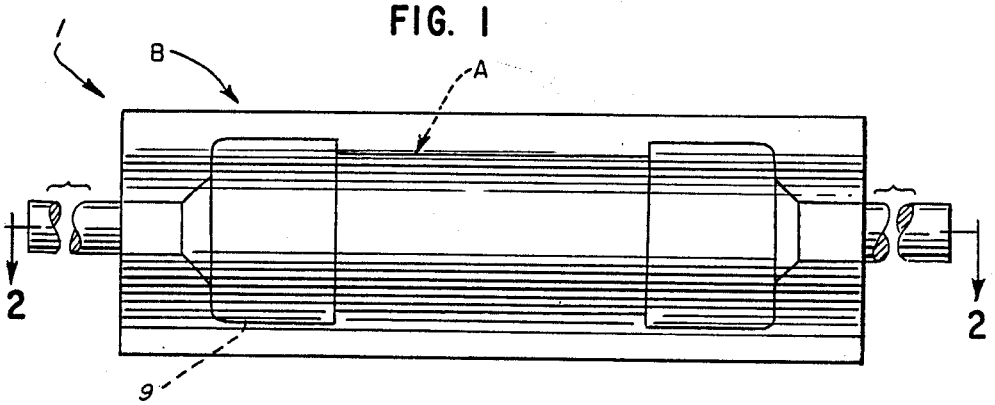
FIG. 1 is an elevational view of a fuse made by the process of the invention.
Figure 2:
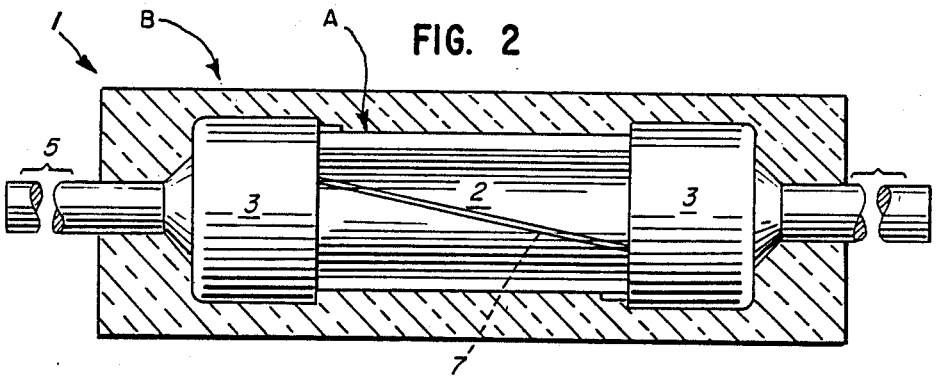
FIG. 2 is a partially longitudinal sectional view of the fuse shown in FIG. 1 showing the outer encapsulation body molded around a main fuse sub-assembly.
Figure 3:
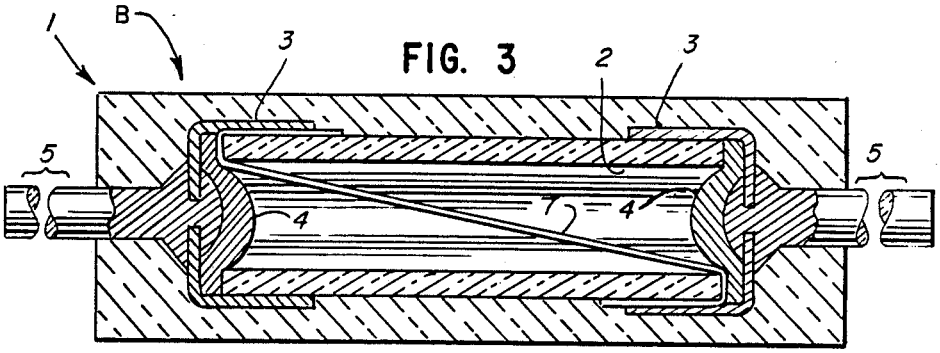
FIG. 3 is a complete longitudinal sectional view through the fuse of FIG. 1.

Referring to FIGS. 1-3 where the fuse 1 of the present invention is shown comprising a main fuse subassembly A encapsulated by a transparent encapsulating body B. The subassembly comprises a length of fuse wire 7 held captive at the ends of an initially open ended cylindrical inner glass housing 2 by means of a pair of cup-shaped metal terminal end caps 3—3 having cylindrical interior recesses receiving the ends of the housing 2 with a pressure fit. A body of solder 4 in each end cap 3 is heated to wet the fuse wire and secure it to the end caps 3—3. Shouldered connecting leads 5—5 pass through the center of the caps 3—3 and are secured by staking prior to assembly of the fuse structure.

The encapsulating body B provides improved structural strength and a complete sealing of the housing 2 and end caps 3-3. The resulting structure is substantially hermetically sealed and, thus, requires no plating of the end caps 3 for corrosion protection, thus resulting in a cost economy in manufacture. The encapsulating body covers the outer exposed surfaces of the housing 2, end caps 3—3, and portions of the leads 5—5 adjacent to the end caps to form a reinforced sealed body which greatly increases the insulation resistance and pull strength of the fuse.

The fuse rating 9 may be imprinted at one or both end portions of the encapsulating body B where the subassembly end caps 3—3 are located, to avoid interfering with the view of the fuse wire 1 visible through the transparent walls of the encapsulating body B and inner housing 2.

The encapsulating body B may be a polypropylene or other suitable moldable synthetic plastic material, such as Rynite or Nylong. It is preferred that a thermoplastic material be used which can be quickly injection molded with water cooled molding equipment of the kind to be described. The fuse subassembly is not preheated as in the epoxy encapsulating process disclosed in U.S. Pat. No. 4,460,887, and so no out-gassing occurs to form blow holes which decreased the insulation resistance of the fuse exterior of the sealed fuse disclosed in the previously mentioned patent. Also, because the epoxy powder application process disclosed in this patent required rotation of the fuse subassembly during application of epoxy powder, the encapsulation process could not be as easily and quickly carried out as in the encapsulation process now to be described.

Refer now to FIGS. 4-6 for a disclosure of the most preferred method for molding the encapsulating body B around each of the fuse subassemblies. As there shown, there are provided two adjacent lines of fuse subassemblies A which are fed through a mold assembly 18 which can simultaneously mold a large number of encapsulation bodies B, such as 25 per line. One of these lines will now be described, it being understood that the other line of fuse subassemblies have encapsulation bodies molded in the same way now to be described. Each line of fuse subassemblies A are supported preferably in a horizontal orientation and at longitudinally spaced points along a pair of horizontally spaced adhesive strips 10—10. The leads 5—5 are shown removably secured to the adhesive coated sides of the strips 10—10. The strips 10—10 are preferably horizontally oriented so that the adhesive coated sides are horizontal co-planar surfaces of the strips. These strips, together with the fuse subassemblies carried thereby, are wound up into a roll 11 upon a supply reel 12.

The supply reel assembly 12 includes a shaft 14 having fuse lead positioning flanges 16—16 between which the outer ends of the fuse assembly leads 5—5 are retained. The roll 11 of carrier strips and fuse subassemblies are unwound from the supply assembly reel 12 and moved to the mold assembly 18. When the carrier strips and fuse subassemblies leave the mold assembly 18, the encapsulation bodies B are molded around the fuse subassemblies A. The encapsulated fuse body assemblies and the carrier strips to which the leads thereof are attached are then moved to a take-up reel assembly 12' having lead-confining flanges 16'—16' similar to the flanges 16—16 on the supply reel assembly 12. The carrier strips 10-10 are rolled upon the shaft 14' of the reel assembly 12.

The take-up reel shaft 14' is connected to a suitable stepping motor 20'. A similar stepping motor 20 is connected to the supply reel assembly shaft 14. The motors 20 and 20' are fed stepping pulses from a controller 21 intermittently to move the 25 fuse subassemblies A of each line on the associated carrier strips 10-10 to the mold assembly 18, as a like number of encapsulated fuse assemblies are moved from the mold assembly 18 toward the take-up reel assembly 12'.

Refer now to FIGS. 4-7 where exemplary apparatus for molding an encapsulating body B around each fuse subassembly is shown. FIG. 5 is a transverse cross sectional view through the mold assembly 18, showing two mold cavities 22—22, one for each line of fuses being processed. Each cavity 22 is formed by upper and lower semi-cylindrical recesses 22A and 22B (FIG. 3) formed in the upper and lower faces of upper and lower mold assembly parts 18A and 18B. These parts are water cooled by the passage of water through passageways 20A—20B in the upper mold assembly part 18A.

When the upper and lower mold assembly parts 18A and 18B are brought together, they define the described mold cavities, each of the size of the encapsulating body B to be formed.

The referred to upper and lower mold assembly parts 18A and 18B are each made up of an assembly of parts, all of which will not be individually described. These parts are carried on movable elements (not shown) which bodily move these parts vertically between spaced and contiguous positions. When the subassemblies are moved to the molding assembly 18, the mold assembly parts 18A and 18B are separated to avoid interference with the movement of these subassemblies. The subassemblies come to rest within the mold assembly, the mold assembly parts are then moved into confronting relationship where the mold cavities are formed therebetween and the molding material fed thereto. The molding material immediately hardens and the mold assembly parts are then separate to permit the molded subassemblies to move on to the take-up reel assembly to enable the subassemblies not yet encapsulated to be moved to the mold assembly.

Communicating with each upper recess 22A in the mold assembly part !8A is a nozzle 24 defining a molding material inlet passageway 24. The nozzle is formed by a metal body having an insulating sleeve 26 which retains heat generated in the interior thereof. The nozzle body illustrated has a pair of molding material feeding passageways 28—28 communicating with the inlet passageway 24. A heating element 30 in the center of the nozzle body generates heat within the nozzle body to keep the thermoplastic molding material involved in a plastic state within the inlet passageway 24. The passageways 28—28 in each nozzle body communicates with a main feed passageway 28, in turn fed from one or more molding material inlet ports 31 provided at the top of the mold assembly part 18A. The ports 31 communicate with a source of molding material which can be fed by a feed screw (not shown) which is intermittently rotated to feed a fixed predetermined amount of molding material from passageway 24 into the associated mold cavity 22 after the mold assembly parts 18A-18B are brought together.

The upper mold assembly part also has heating elements 30, to keep the molten material in the passageway 28, in a molten state at all times. To stabilize the temperature involved, a power and thermocouple mold plug 34 is provided which controls current flow from a suitable current source to the heating elements 30 and 30' contained in the upper mold assembly part 18A. Because substantially the entire surface area of the mold cavity defined by the recesses 22A–22B are cooled surfaces, the encapsulating bodies B are quickly formed in a hardened state. When the mold assembly parts 18A and 18B are then separated, the hardened encapsulating body B is cleanly separated from the still molten material in each passageway 24. The entire surface area of the encapsulating body B is a smooth cylindrical surface when the molded cavity-forming parts are separated.

One example of a fuse made in accordance with the present invention having a 15 amp rating had a glass housing length of 0.228 inches, a housing outer diameter of 0.055 inches, a housing wall thickness of 0.013 inches, an end cap outer diameter of 0.073 inches, an encapsulating body outer diameter of 0.095 inches, a lead diameter of 0.024 inches, and a lead pull strength of well above 10 pounds.

The present invention thus provides a high speed, reliable and effective method for making the unique encapsulated fuses of the present invention.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A miniature cartridge fuse having a length no more than about one quarter inch, and an outer diameter no greater than about 0.1 inch, said fuse comprising: a subassembly of an inner transparent insulating housing which cannot withstand short circuit blowout conditions, a fuse element disposed within said inner housing and a pair of conductive terminals at the opposite axial ends of said housing electrically and physically connected to the ends of said fuse element; said sub-assembly being encapsulated by an outer transparent encapsulating body of insulating material immediately surrounding the exterior surfaces of said inner housing to reinforce it for substantially its entire extent, and said encapsulating body being made of transparent material to enable the fuse element to be seen through and the surrounding encapsulation material, and is a much stronger material than the material out of which said inner housing is made and to prevent the explosion of the fuse under fuse blowout conditions.

2. The cartridge fuse of claim 1 wherein said inner housing is made of glass and said encapsulation body is a molded transparent synthetic plastic material.

3. The cartridge fuse of claim 2 wherein said inner housing is an open ended body, and said terminal means being cupshaped end caps telescoping over the ends of said housing and anchored thereto by solder within the housing.

4. The cartridge fuse of claim 3 or 2 wherein said fuse has a rated current of at least about 15 amps.

5. The cartridge fuse of claim 3 or 2 wherein there are conductive leads extending from said terminals, said encapsulating body surrounding and sealed around said leads.

6. The cartridge of claim 2, 3 or 4 wherein there are conductive leads extending from said terminals, said encapsulating body surround and sealed around said leads, said inner housing is an open ended body, and said terminals are cup-shaped end caps telescoping over the ends of said housing and anchored thereto by solder within the housing, said leads extending outwardly of said terminals and said encapsulating body is molded around said inner housing, terminals and inner portions of said leads.

* * * * *

UNITED STATES PATENT AND TRADEMARK OFFICE

CERTIFICATE OF CORRECTION

PATENT NO. : 4,918,420

DATED : April 17, 1990

INVENTOR(S) : William Sexton

It is certified that error appears in the above-identified patent and that said Letters Patent is hereby corrected as shown below:

On the title page, insert the following:

-- [73] Assignee: Littelfuse, Inc., Des Plaines, Ill. --.

Signed and Sealed this

Twenty-sixth Day of November, 1991

*Attest:*

HARRY F. MANBECK, JR.

*Attesting Officer*

*Commissioner of Patents and Trademarks*